US005696346A

United States Patent [19]

Erning

[11] Patent Number: 5,696,346

[45] Date of Patent: Dec. 9, 1997

[54] RIFLE WITH DUAL FUNCTION TRIGGER

[76] Inventor: Torsten Erning, Eschstrasse 67, 48703 Stadtlohn/DE, Germany

[21] Appl. No.: 522,256

[22] PCT Filed: Jan. 11, 1994

[86] PCT No.: PCT/DE94/00019

§ 371 Date: Oct. 20, 1995

§ 102(e) Date: Oct. 20, 1995

[51] Int. Cl.[6] ..... F41A 19/35

[52] U.S. Cl. ..... 89/147; 42/69.03

[58] Field of Search ..... 89/147; 42/69.03, 42/20–22

[56] References Cited

U.S. PATENT DOCUMENTS

| | | | |
|---|---|---|---|
| 859,974 | 7/1907 | von Pocci | 42/69.03 |
| 2,441,029 | 5/1948 | Nyvall et al. | 89/147 |
| 2,863,247 | 12/1958 | Benson | 42/20 |
| 4,028,835 | 6/1977 | Canjar | 42/69.03 |
| 5,000,075 | 3/1991 | Tuma | 89/147 |

FOREIGN PATENT DOCUMENTS

| | | | |
|---|---|---|---|
| 125523 | 10/1947 | Australia | 42/69.03 |
| 0540778A1 | 5/1993 | European Pat. Off. . | |
| 922904 | 6/1947 | France . | |

*Primary Examiner*—Stephen M. Johnson
*Attorney, Agent, or Firm*—Lahive & Cockfield, LLP

[57] ABSTRACT

The invention proposes a trigger assembly known as a "double-action" assembly, like that used in pistols, for a rifle, with this assembly being designed for use in a rifle in such manner that the hammer is located ahead of the trigger. Such a trigger assembly in a rifle both ensures that the rifle can be fired rapidly and also prevents a shot from being fired inadvertently.

8 Claims, 9 Drawing Sheets

RIFLE WITH DUAL FUNCTION TRIGGER

BACKGROUND OF THE INVENTION

The invention relates to a rifle according to the preamble of claim 1.

Rifles for crime fighting are often used at relatively short range. Since unanticipated situations frequently arise requiring a very rapid reaction, police may be faced with a life-threatening disadvantage if they must load their rifles before they can fire a shot.

On the other hand it is dangerous to carry a loaded weapon, since inadvertent contact with the trigger or inadvertent vibration of the weapon may trigger an undesired shot. For this reason, it is frequently forbidden by law to carry rifles in a loaded condition.

One object of the invention is to provide a rifle which is both safe and permits rapid firing thereof.

SUMMARY OF THE INVENTION

This goal is achieved by virtue of the fact that the weapon includes a trigger assembly that is designed as a double-action assembly.

The invention, in other words, proposes the provision of a trigger assembly designed as a double-action assembly. In such dual-action assemblies, the movement of the trigger both cocks the hammer and fires the shot. The fact that work must be performed with the aid of the trigger to cock the hammer means that such assemblies have relatively high trigger weights.

Rifles are usually used as weapons at long range. High trigger weights are generally known to be undesirable under these circumstances since they can cause the weapon to be moved inadvertently so that the aim is relatively inaccurate at high trigger weights, especially at long range. The invention therefore proposes using an assembly that was heretofore considered disadvantageous for use with rifles. Surprisingly, the use of an assembly which is thus considered disadvantageous for rifles offers an advantage for special applications of rifles. When an assembly according to the invention is used, the rifle can always be loaded, so that the shot can be triggered merely by operating the trigger without it being necessary to load the weapon in advance. The term "rifle" is intended to include all relatively long guns, such as those that are typically placed against the shoulder of the user, and is not intended to include short guns such as revolvers or pistols.

At the same time, however, the weapon is relatively safe. According to one practice, hammer abuts a safety latch in a locking position and cannot strike the firing pin even with the strongest of vibrations, where the pin acts on the cartridge and firing the shot. At the same time, the increased trigger weight nearly excludes inadvertent movement of the trigger.

In weapons equipped according to the invention an that are stored in the home, the increased trigger weight ensures that handling of the weapon by children is safer since small children in particular cannot exert the required force to operate the trigger with the increased trigger weight.

Advantageously, a two-part push rod can be provided between the trigger and the hammer, with the trigger moving the hammer with the aid of the push rod from its relaxed position or from its partially cocked safety position into the cocked position. When the hammer flies from its cocked position into the relaxed position, in which it strikes the firing pin and fires the shot, the hammer inadvertently catches the part of the push rod adjacent to it and holds it until the hammer has been moved backward into a position that is located beyond its safety position. This ensures that the hammer can only be acted on by the trigger when the hammer is in its safety position, so that a shot can only be fired deliberately.

Advantageously, the safety latch can be arranged so that the hammer is near the relaxed position in its safety position. This ensures that the overwhelming majority of the effort required to cock the hammer must be applied by the trigger. This has two consequences. Firstly, the large amount of work that is done by the trigger creates a correspondingly high trigger weight, with the above-mentioned safety advantages. Secondly, the hammer has very little energy in its safety position because it is cocked to only a very small degree. Even if the safety latch were to fail, the hammer would have so little energy that no shot could be fired when the hammer struck the firing pin.

The invention will now be described in greater detail with reference to the drawings.

DESCRIPTION OF ILLUSTRATED EMBODIMENT

Figure 1:
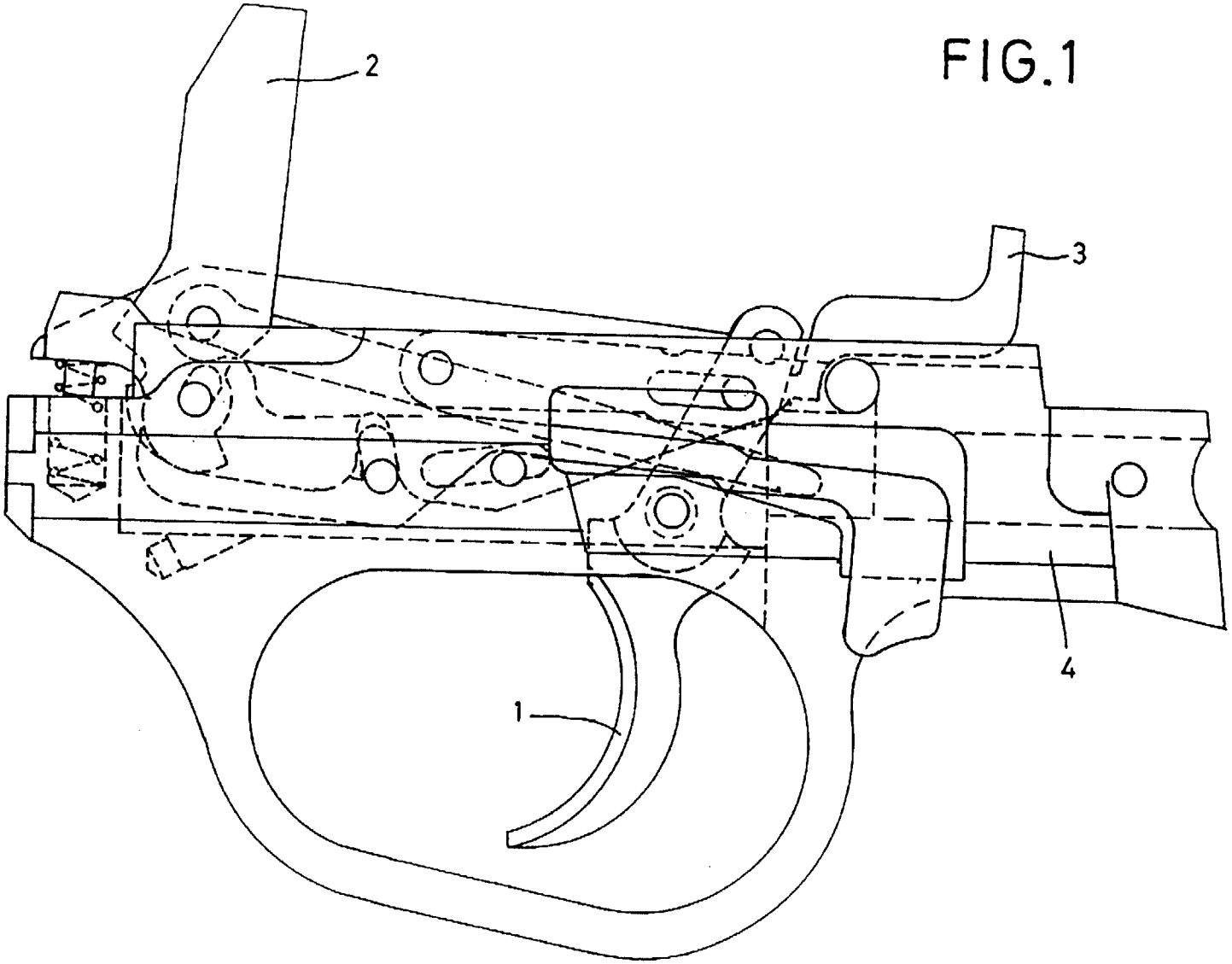
FIGS. 1, 2, and 8 are side views of the trigger assembly according to the invention.

FIG. 1 shows a trigger assembly comprising, among other parts, a trigger 1, hammer 2, and safety pin 3. The entire assembly can be replaced as a complete unit, as is known for example in rifles made by the Mossberg Company. Such a modular design of the weapon makes it possible to replace an existing trigger assembly by the dual-function shown, without major interventions in the weapon being required. For this purpose, the movable elements of the trigger assembly are located in a housing 4 which corresponds in its shape and dimensions to the housing of the mass-produced trigger assembly of the rifle.

Figure 2:
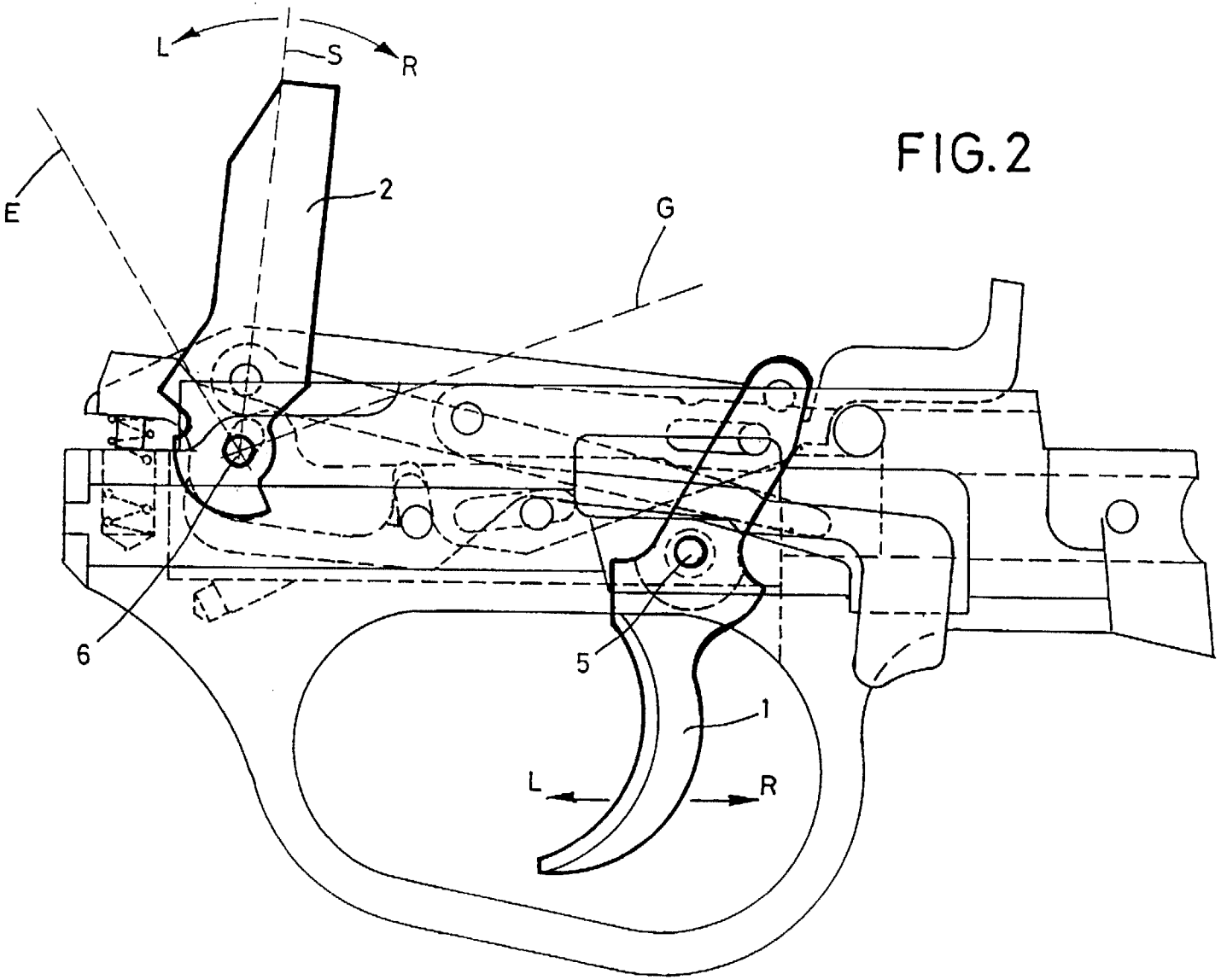

In FIG. 2, trigger 1 is shown with emphasis, and is pivotably movable about a pivot 5. Trigger 1 can be moved rearward from the position shown, i.e. rightward into arrow R, until a shot is fired. Then trigger 1 can be moved back for example by spring force, leftward in the direction of arrow L into the position shown in FIG. 2.

As a result of the pivoting motion around pivot 5, the part of trigger 1 that is above pivot 5 moves to the left when the trigger is pulled in the direction of arrow R. This forwardly directed movement of the upper part of the trigger is transmitted to a lower portion of hammer 2, as will be explained later. Hammer 2 then pivots around a pivot 6 with the lower part of hammer 2 moving leftward and the part of the hammer that is above pivot 6 moving rightward.

In FIG. 2, hammer 2 is shown in a safety position represented by dashed line S. As a result of the described rightward motion of trigger 1, hammer 2 is cocked, whereupon it moves in the direction of the cocked position represented by dashed line G. Hammer 2 is freed by a further movement of trigger 1, as will be described below, so that it flies forward from its cocked position G into its relaxed position, represented by dashed line E. When the trigger assembly shown is installed in a rifle, this results in hammer 2 striking a firing pin that conducts the blow to a cartridge and thus triggers the shot.

Figure 3:
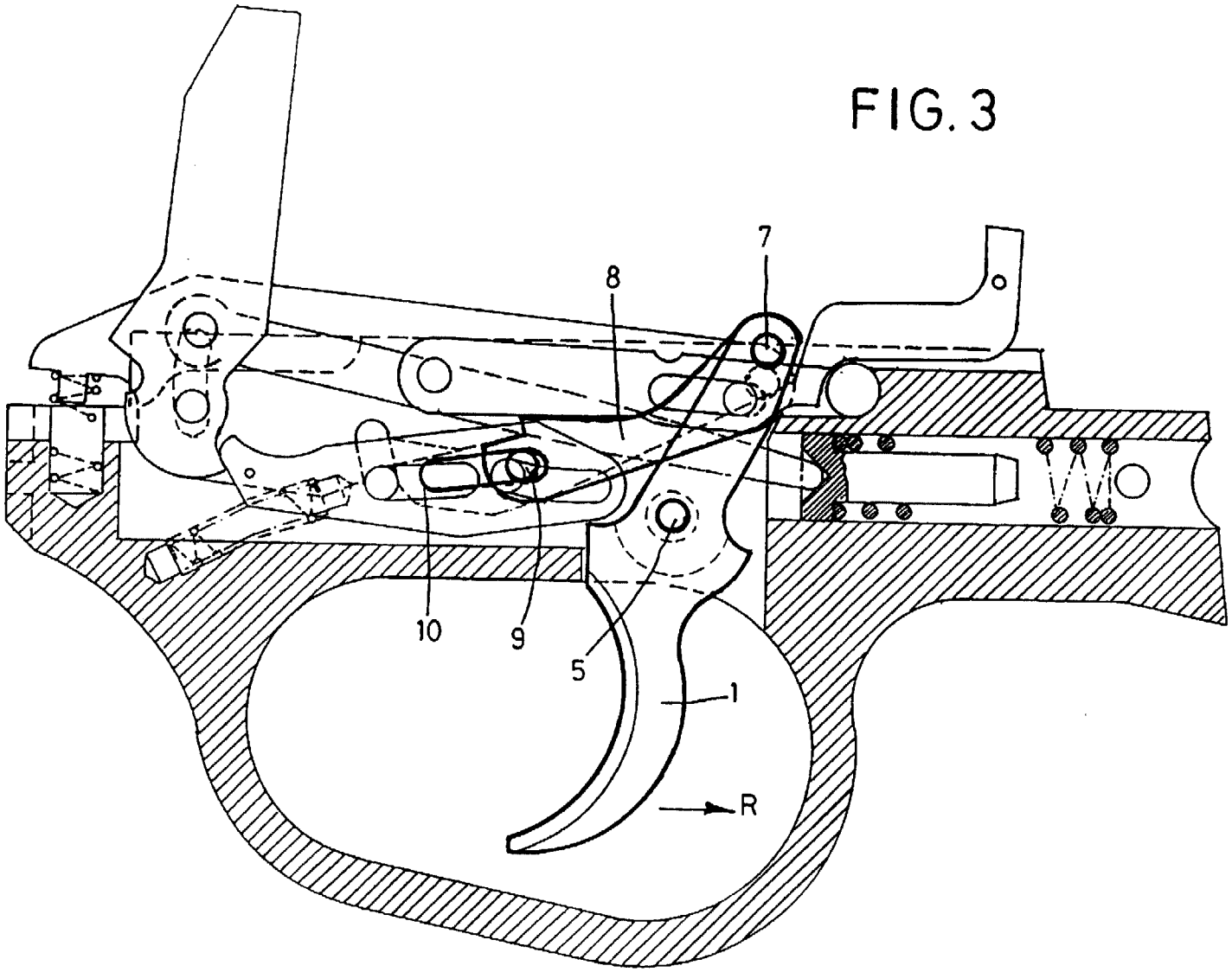
FIGS. 3 through 7 are sectional views through the trigger assembly in FIGS. 1, 2, and 8.

Transmission of movement of trigger 1 to hammer 2 is now described in more detail. FIG. 3 shows trigger 1 which has a connecting pin 7 in its upper part. A first pushing element 8 is pivotably mounted on connecting pin 7, with first pushing element 8 having a guide pin 9 which is guided in an elongated hole 10. Elongated hole 10 is located in a disconnector element, as described below. When trigger 1 is moved to the right, its upper part moves leftward with connecting pin 7 and also presses first pushing element 8 leftward as well, whereupon guide pin 9 slides leftward in elongated hole 10.

Figure 4:
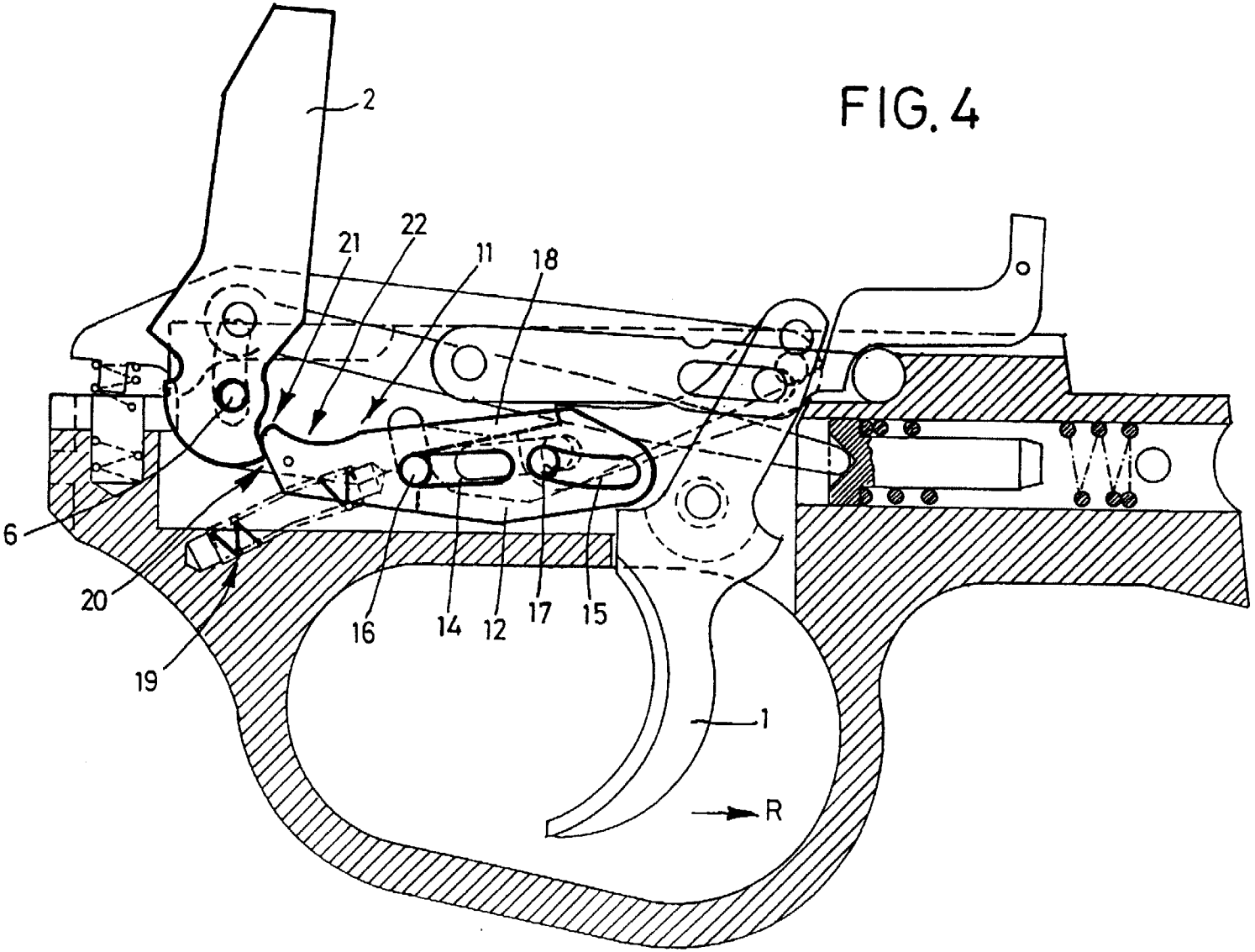

FIG. 4 shows a second pushing element 11 which is pushed leftward by first pushing element 8 when trigger I is pulled to the right. Second pushing element 11 is made relatively thick and has a forward plate 12 represented in FIG. 4 by solid lines. The forward plate has two elongated holes 14 and 15. Each of the elongated holes 14 and 15 is mounted on a fixed pin 16 and 17, respectively, so that the second pushing element 11 is guided along these two fixed pins 16 and 17 during its motion.

Second pushing element 11 also comprises a pressure rib 18 which is located behind front plate 12 and is represented by dashed lines in FIG. 4. The motion of second pushing element 11 to the left takes place against the action of a compression spring 19.

During the leftward movement of second pushing element 11, the forward edge of second pushing element 11 abuts the lower part of hammer 2, which is located below pivot 6. As a result of this contact, second pushing element 11 constitutes a safety latch for hammer 2, since hammer 2 cannot move of itself from its safety position "S" shown in the drawing into relaxed position "E."

Referring to FIGS. 2, 3 and 4, first and second pushing elements 8 and 11 form a common yet separable push rod that transmits motion from trigger 1 to hammer 2. During this motion, hammer 2 moves from its safety position S into its cocked position G. When the hammer 2 is disposed in the cocked position G, an edge 20 of hammer 2 abuts an edge 21 of second pushing element 2. When trigger 1 is moved further to the right in this position, the two edges 20 and 21 slide off one another, releasing hammer 2, which moves forward out of the cocked position G and into the relaxed position E.

In this position, second pushing element 11 is displaced all the way leftward, so that as a result of the positions of the two elongated holes 14 and 15, second pushing element 11 is not only displaced leftward, but is also lowered, so that the bottom section of hammer 2 can slide on the bent saddle portion 22 of the second pushing element 11.

When trigger 1 is released from this position, in other words after the shot is fired, its lower portion pivots leftward under spring force into the position shown in the drawing. It then pulls back first pushing element 8 with connecting pin 7, while second pushing element 11 is retained in its leftmost position, in other words in its forward position, since the lower portion of hammer 2 abut the saddle portion 22 and the forward edge 21 of the second element 11. In addition, second pushing element 11 is forced upward by spring 19, so that second pushing element 11 cannot pass beneath the lower portion of hammer 2 and move rightward into its starting position, as shown in FIG. 3.

Figure 5:
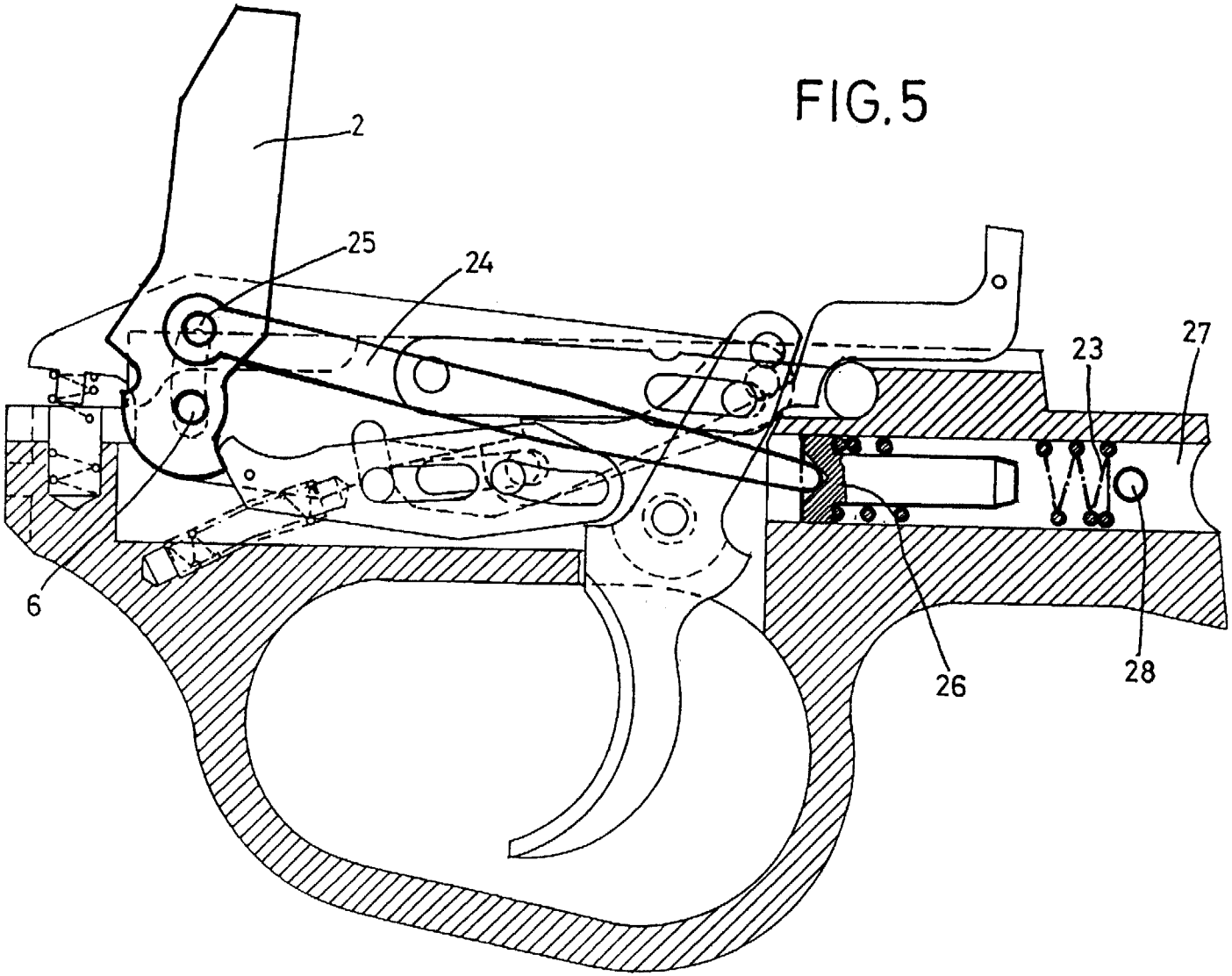

The energy required to move hammer 2 from its cocked position G into its relaxed position E is provided by a compression spring 23, as shown in FIG. 5. Here it is evident that hammer 2 is connected with a push rod 24 mounted pivotably about a pin 25. Push rod 24 extends from hammer 2 and pin 25 up to a pressure bearing 26, preferably in the form of a pin abutting compression spring 23. Compression spring 23 is disposed in a bore 27 formed in the housing 4 of the rifle and abuts a cross pin 28.

The movement of hammer 2 from its safety position S into cocked position G means that compression spring 23 is compressed. When hammer 2 is released from the cocked position G, compression spring 23 expands and drives pressure bearing 26, pressure rod 24, and hammer 2 forward, (e.g., to the left) whereupon hammer 2 pivots around pivot 6 until it has reached its relaxed position E.

Figure 6:
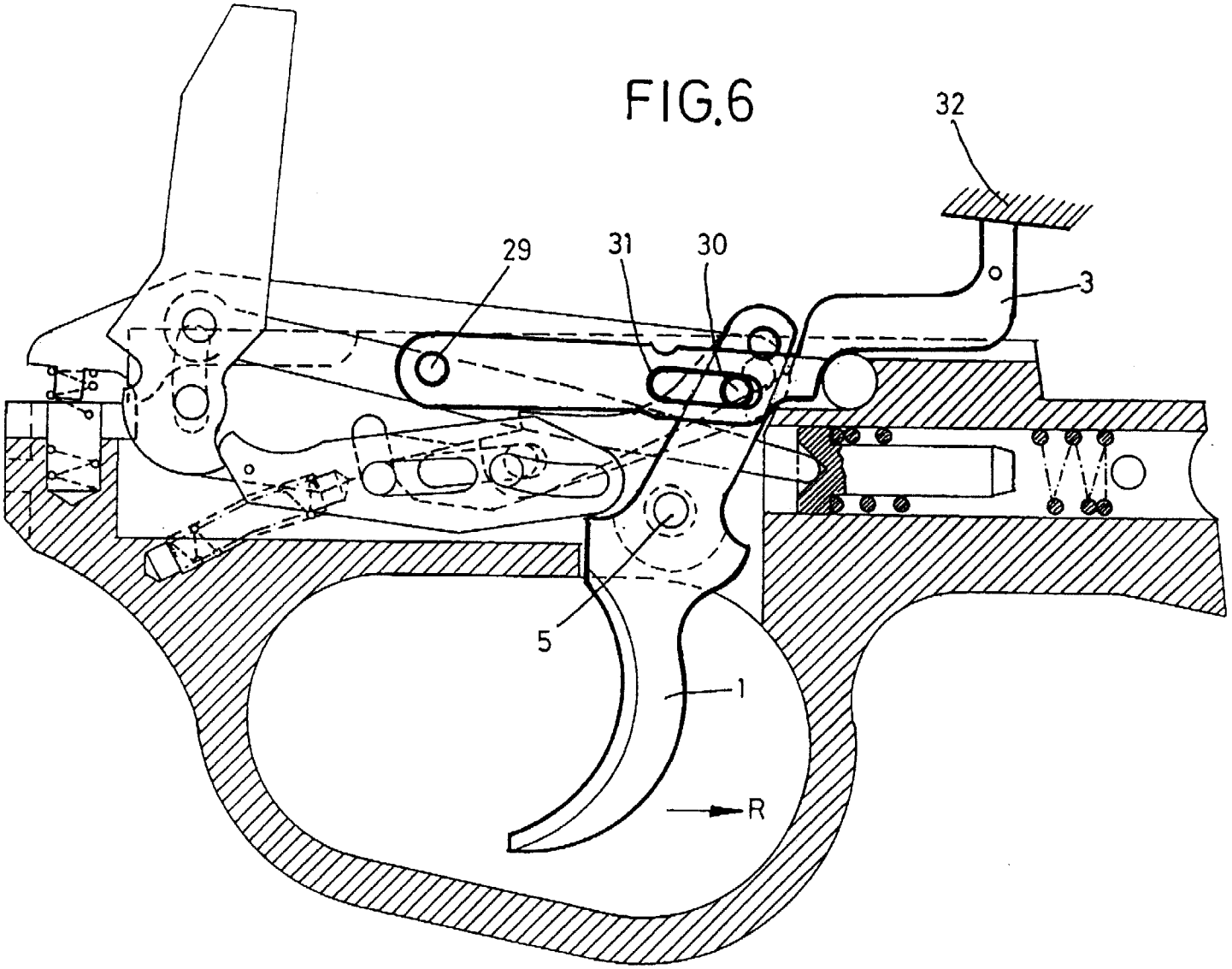

FIG. 6 shows the function of safety pin 3. Safety pin 3 is designed as a long lever, pivotable around a pivot 29. A pin 30 is permanently mounted in the upper part of trigger 1 and is guided in an elongated hole 31 of safety pin 3. When trigger 1 is moved rightward and pivots around pivot 5, the upper portion of trigger 1 is moved leftward, whereupon pin 30 describes a circular movement upward and leftward with respect to pivot 5.

Since pin 30 abuts the contour of elongated hole 31, safety pin 3 is raised by the upward component of this motion. Therefore, a safety slide or safety pin or the like can be provided on the housing of the weapon, as shown purely schematically by 32 in FIG. 6. In its securing position, a safety slide 32 of this kind lies directly above the upper end of safety pin 3, so that upward movement of safety pin 3 is not possible. This blocking action also prevents movement of pin 30 and hence a movement of trigger 1, so that the weapon is completely secured.

Figure 7:
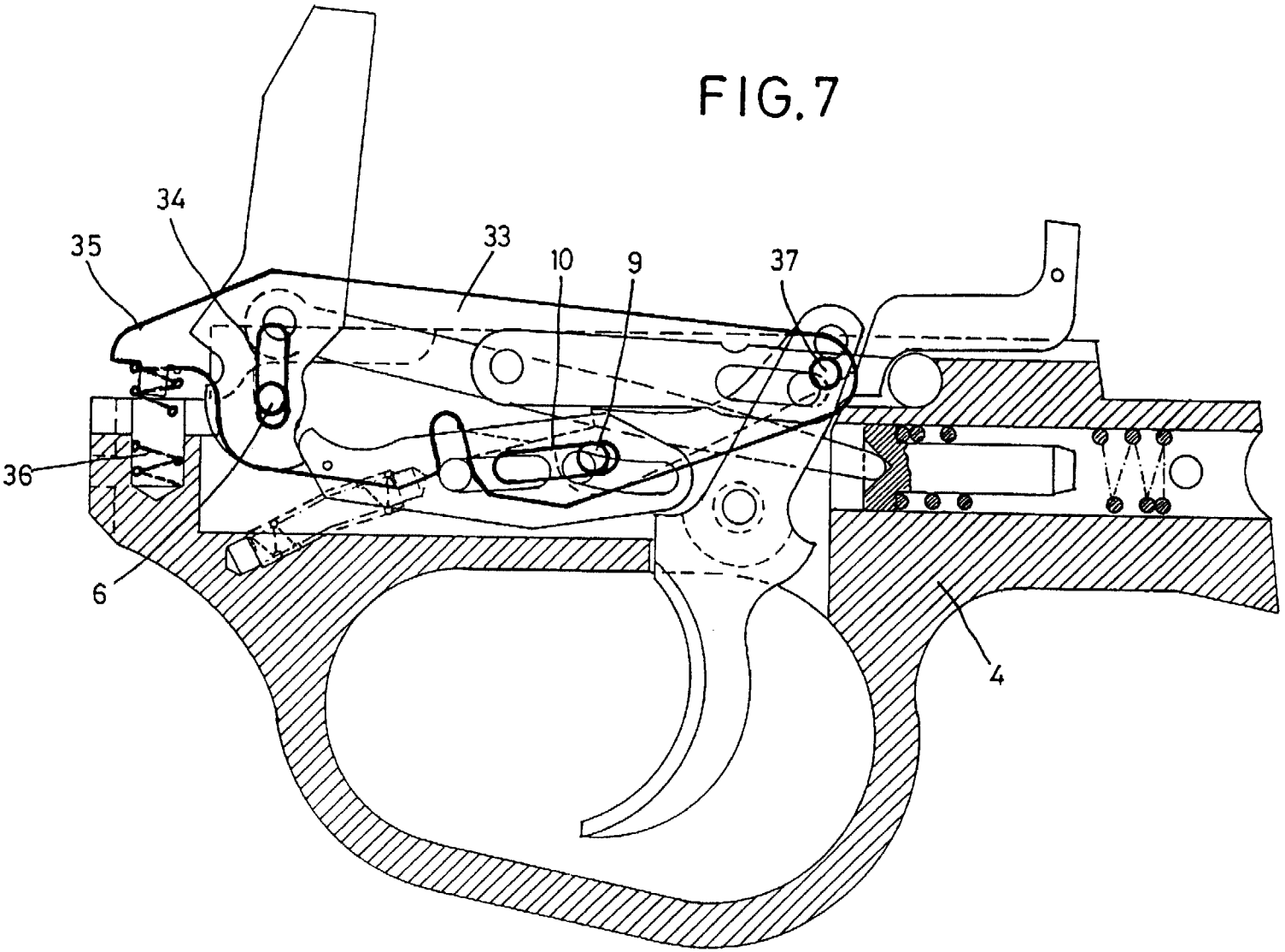

FIG. 7 shows a disconnector 33, with an elongated hole 10 that serves as a guide for guide pin 9 of first pushing element 8. Disconnector 33 has a forward, approximately vertical elongated hole 34 that surrounds a horizontal pin extending transversely through the entire width of housing 4 and forming pivot 6 for hammer 2.

When a weapon employing the illustrated trigger assembly is loaded, the lock of the weapon is guided rearward, whereupon among other things hammer 2 is pivoted from the safety position S into the cocked position G. During this motion, the lock encounters a forward, diagonally disposed sliding surface 35 of disconnector 33.

Disconnector 33 is pivotably movable against the action of a spring 36 around a pivot 37 so that the forward part of disconnector 33, at the left in FIG. 7, is moved downward. As a result of this motion, guide pin 9 of first pushing element 1 is also pressed downward in its elongated hole 10, so that first pushing element 8 as a whole is pivoted downward, with connecting pin 7 serving as a pivot. In this manner, first pushing element 8 with its forward stop edge travels beneath pressure rib 18 of second pushing element 11, and in this manner the two pushing elements 8 and 11 are decoupled from one another, as the weapon is loaded.

Figure 8:
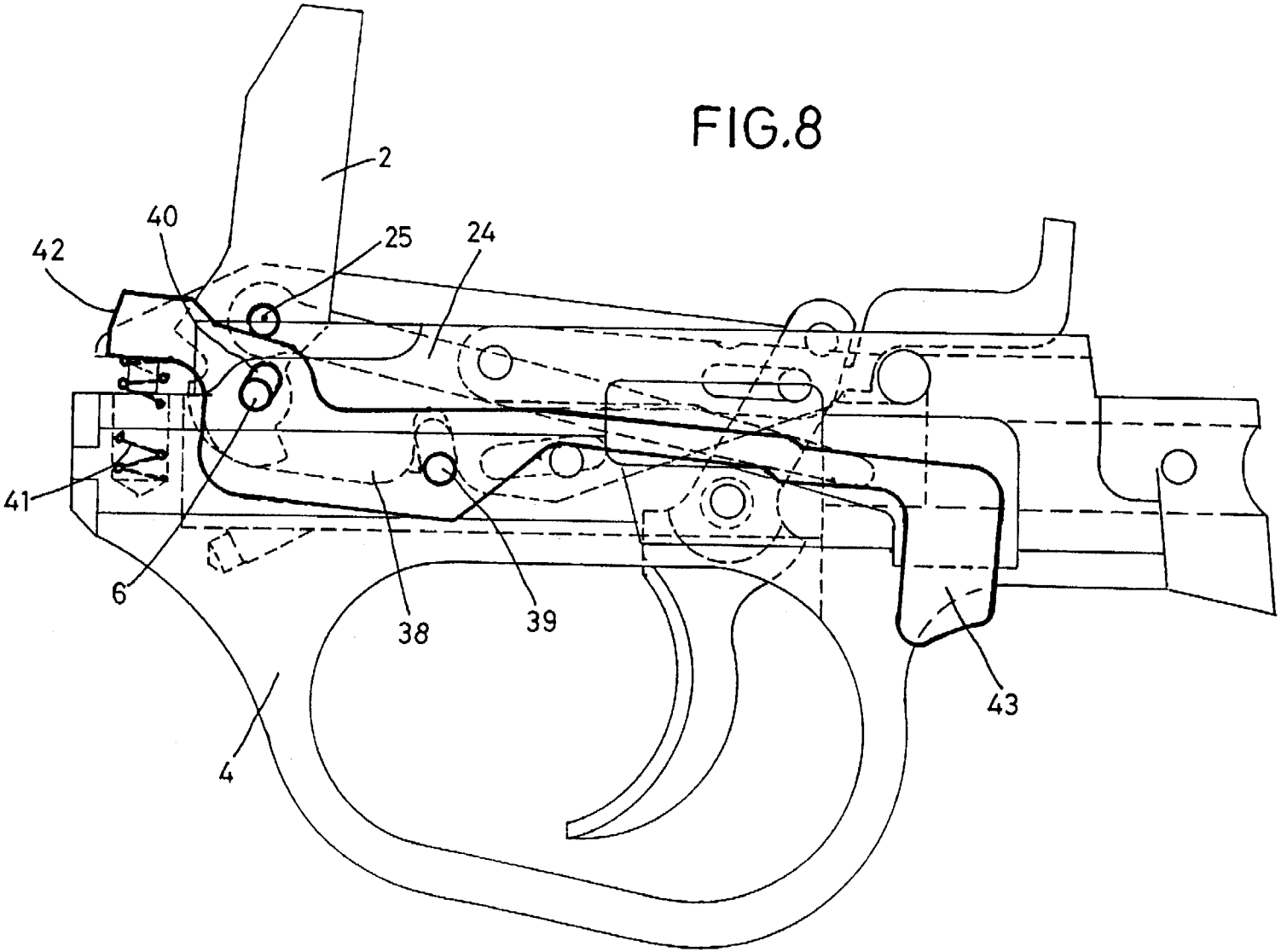

FIG. 8 shows a locking lever 38 pivotable around a pivot 39. Locking lever 38 has an elongated hole 40 in its forward area for the pin that extends transversely through housing 4 and forms pivot 6 for hammer 2. The forward end of locking lever 38 abuts housing 4 by means of a spring 41, so that locking lever 38 is usually located in its locking position shown in FIG. 8. In this locking position, the forward end, shown at the left in FIG. 8, is lifted by its locking edge 42. Consequently, it is not possible to move a weapon lock in the fashion required to load the weapon, since the lock abuts locking edge 42 of locking lever 38 during this movement. Pin 25, which connects hammer 2 with pressure rod 24, is brought out of hammer 2 and abuts the upper edge of locking lever 38 as shown in FIG. 8.

When the shot has been fired and hammer 2 has pivoted into its relaxed position, which is located further to the left than the position shown in FIG. 8, pin 25 presses the left part of locking lever 38 downward against the action of spring 41 so that locking edge 42 of locking lever 38 is located low enough to allow the lock of the weapon to be guided over locking edge 42, and the weapon can be loaded.

The lock must also be movable to unload the weapon, in other words to remove a cartridge from the barrel. For this purpose, locking lever 38 has a rear operating tongue 43 that projects out of housing 4 and may be operated manually. When this actuating tongue 43 is pressed upward, locking lever 38 pivots around pivot 39 so that the forward end of locking lever 38 is lowered along with locking edge 42.

Figure 9:
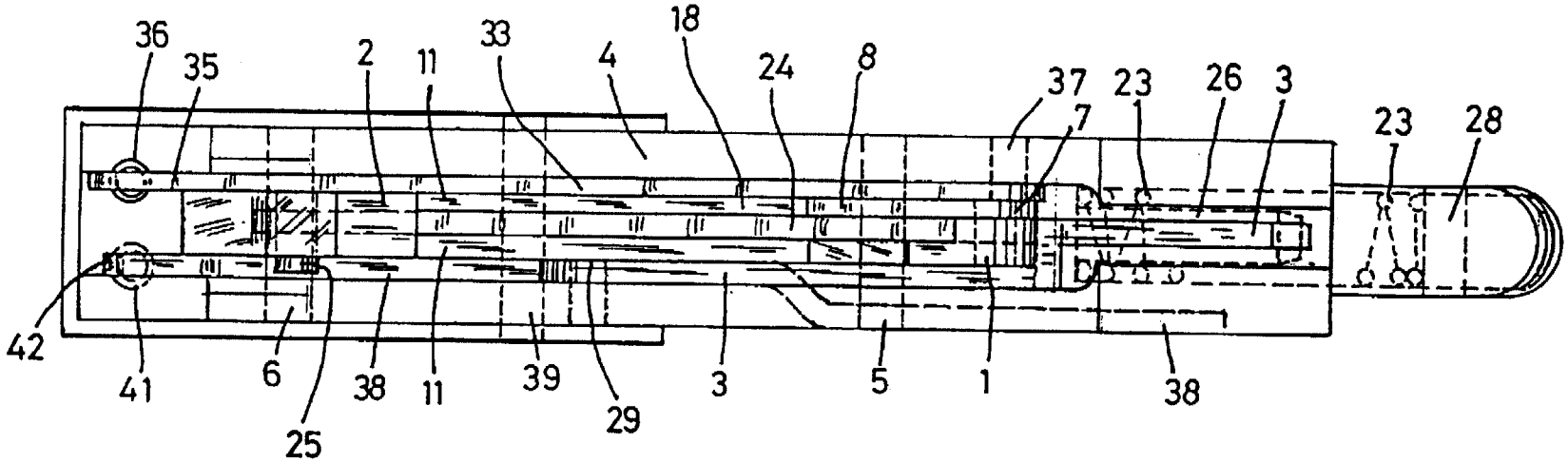
FIG. 9 is a top view of the trigger assembly in FIGS. 1 through 8.

FIG. 9 is a top view of the assembly shown in FIGS. 1 to 8. Housing 4 is visible, with hammer 2 located in the forward part, in other words in the area shown at the left in FIG. 9, from which hammer pin 25 projects laterally. Locking lever 38 is visible beneath pin 25 with its forward spring 41 and forward locking edge 42. Disconnector 33 can be seen on the other side of the entire assembly, with its forward sliding surface 35 and spring 36. Push rod 24 extends from hammer 2 to pressure bearing 26 with the compression spring 23, between disconnector 33 and locking lever 38, abutting cross pin 28.

The illustrated locking pin 3 is disposed above pressure bearing 26, pin 3 being approximately Z-shaped and located centrally in the rear area above pressure bearing 26, while its forward area is located laterally and extends up to pivot 29.

Behind hammer 2, in other words to the right of hammer 2, second pushing element 11 can be seen which is wider than push rod 24 and therefore can be seen on both sides of push rod 24. The part of the second pushing element 11 that is shown above push rod 24 in FIG. 9 forms pressure rib 18, which adjoins first pushing element 8. First pushing element 8 therefore extends up to connecting pin 7 by which it is connected with the upper part of trigger 1.

Finally, locking lever 38 is shown shaded in those areas where it is guided along the surface of housing 4. Housing 4 has a corresponding indentation at this location so that this rear part of the locking lever 38 together with actuating tongue 43 can be seen and is operable externally on housing 4 but does not project laterally beyond the outline of housing 4.

I claim:

1. Rifle with a trigger assembly, comprising a trigger and a hammer, said hammer being movably mounted between a cocked position and a relaxed position, with said hammer in its relaxed position abutting a firing pin to fire a shot and with said hammer being located forward of the trigger, wherein said trigger assembly is designed as a double-action assembly, in which a rearward movement of the trigger initially moves the hammer into said cocked position and then subsequently releases the hammer where it moves from the cocked position to the relaxed position, the hammer being movable, without operation of the trigger, into the cocked position, and wherein the hammer is automatically pivotable from the cocked position into a partially cocked safety position located between the cocked position and the relaxed position, wherein the hammer abuts a stop element that prevents further movement of the hammer into the relaxed position when disposed in the partially cocked safety position.

2. Rifle according to claim 1, further comprising a push rod element having a first element and a second element and extending from the trigger to the hammer, wherein the second element abuts a selected portion of the hammer when the hammer is disposed in the relaxed position, and wherein the portion of the second element that abuts the hammer is released when the hammer moves to a selected position beyond the safety position.

3. Rifle according to claim 2, wherein the first element is coupled to the second element and the first element is disposed adjacent to the trigger and is connected with a disconnector element that is capable of being depressed, wherein the depression of the disconnector element depresses the first element such that the connection between the first element and the second element is broken.

4. Rifle according to claim 1, wherein the safety position of the hammer is disposed close to the relaxed position and remote from the cocked position.

5. Rifle according to claim 1, wherein the hammer is axially spaced from the trigger and is disposed proximal to a front portion of the rifle.

6. Rifle with a trigger assembly, said trigger assembly comprising a trigger and a hammer, said hammer being movably mounted between a cocked position and a relaxed position, with said hammer in its relaxed position abutting a firing pin to fire a shot and with said hammer being located forward of the trigger, wherein said trigger assembly is designed as a double-action assembly, in which a rearward movement of the trigger initially moves the hammer into said cocked position and then subsequently releases the hammer where it moves from the cocked position to the relaxed position, the hammer being movable, without operation of the trigger, into the cocked position, and wherein the hammer is automatically pivotable from the cocked position into a partially cocked safety position located between the cocked position and the relaxed position, wherein the hammer abuts a stop element that prevents further movement of the hammer into the relaxed position when disposed in the partially cocked safety position, and wherein the rifle includes a push rod element having a first element and a second element, said push rod element extending from the trigger to the hammer, said second element abutting a selected portion of the hammer when the hammer is disposed in the relaxed position, and wherein the portion of the second element that abuts the hammer is released when the hammer moves to a selected position beyond the safety position, said first element being coupled to the second element and is disposed adjacent to the trigger and is connected with a disconnector element that is capable of being depressed, wherein the depression of the disconnector element depresses the first element such that the connection between the first element and the second element is broken.

7. Rifle according to claim 6, wherein the safety position of the hammer is disposed close to the relaxed position and remote from the cocked position.

8. Rifle according to claim 6, wherein the hammer is axially spaced from the trigger and is disposed proximal to a front portion of the rifle.

* * * * *